US006110349A

United States Patent [19]

Kawamura et al.

[11] Patent Number: 6,110,349

[45] Date of Patent: Aug. 29, 2000

[54] METHOD FOR RECOVERING METALLIC TIN FROM ELECTROPLATING SLUDGE

[75] Inventors: Katsuhito Kawamura; Fuyuhiko Ishikawa; Kazumitsu Sambonchiku; Kei Yuki, all of Chiba; Shinji Kawashima; Toshimichi Ukena, both of Tokyo, all of Japan

[73] Assignee: Kawasaki Steel Corporation, Hyogo, Japan

[21] Appl. No.: 09/170,066

[22] Filed: Oct. 13, 1998

[30] Foreign Application Priority Data

Mar. 25, 1998 [JP] Japan ..... 10-078075

[51] Int. Cl.[7] ..... C25C 1/14

[52] U.S. Cl. ..... 205/611

[58] Field of Search ..... 205/610, 611

[56] References Cited

U.S. PATENT DOCUMENTS

| | | | |
|---|---|---|---|
| 1,511,590 | 10/1924 | Butterfield | 205/611 |
| 3,907,653 | 9/1975 | Horn | 204/94 |
| 4,006,213 | 2/1977 | Fisher et al. | 423/92 |
| 4,737,351 | 4/1988 | Krajewski et al. | 423/98 |
| 5,766,440 | 6/1998 | Ino et al. | 205/99 |

FOREIGN PATENT DOCUMENTS

| | | |
|---|---|---|
| 363057712 | 8/1986 | Japan . |
| 363277782 | 5/1987 | Japan . |
| 409067699 | 8/1995 | Japan . |
| 410072629 | 9/1996 | Japan . |

*Primary Examiner*—Donald R. Valentine
*Attorney, Agent, or Firm*—Young & Thompson

[57] ABSTRACT

Improved recovery of tin from sludge formed during a halogen-type electrolytic tinplating of steel sheet comprises leaching the sludge with water at a pH of 7 or less, separating an iron-containing sludge remaining after the leaching, alkalifying the filtrate obtained in the first separation step to deposit tin-containing sludge, separating and recovering the tin-containing sludge deposited in the first alkalifying step, redissolving the tin-containing sludge in an alkaline solution, and electrolytic reduction of the alkaline solution. High purity metallic tin is recovered from sludge, at a high yield. Other materials are also recovered for reuse from the filtrate and precipitation, which are formed during the process, without pollution of the operational environment.

16 Claims, 5 Drawing Sheets

METHOD FOR RECOVERING METALLIC TIN FROM ELECTROPLATING SLUDGE

BACKGROUND OF THE INVENTION 1. Field of the Invention

The present invention relates to a method for processing the sludge, that inevitably forms during halogen-type electrolytic tinplating. In particular, the present invention relates to a method for recovering metallic tin at a high yield and at a high purity from the sludge. Further, the present invention relates to a method for processing sludge generated by halogen-type electrolytic tinplating in which other useful materials can be recovered for reuse from the filtrates and the precipitates resulting from the process. 2. Description of the Related Art Halogen-type electrolytic tinplating producing is one of the continuous manufacturing methods for tin-electroplated steel sheets. The halogen-type electrolytic tinplating process uses a halide electrolytic bath which contains for example a hydrogen halide solution such as hydrochloric acid, stannous chloride, sodium chloride, sodium fluoride, sodium hydrogen fluoride and the like. By electroplating using a combination of metallic tin as an anode and an advancing steel sheet as a cathode, metallic tin is electrodeposited on the surface of the steel sheet.

A halogen-type electrolytic tinplating process using an acidic electrolyte (plating solution) is advantageous in that the metallic tin at the anode can be dissolved as available stannous ions. However, some of the stannous ions are simultaneously oxidized by oxygen to stannic ions, which results in the formation of a large amount of sludge. The resulting sludge contains sodium hexafluorostannate ($Na_2SnF_6$) as one of the main components. The sludge also contains a small amount of sodium hexafluoroferrate ($Na_3FeF_6$) which includes ferric ions dissolved from the steel sheet.

Sludge is also formed by ferrous ions dissolved from the steel sheet into the plating solution. Although the halogen-type electrolytic tinplating process permits high current density operation and is suitable for a high-speed production line, the high-speed advancement of the steel sheet causes agitation of the plating bath and thus introduction of air into the bath. Currents in the plating bath also cause introduction of air into the bath. Ferrous ions are consequently oxidized by oxygen dissolved into the plating bath to form ferric ions. In the plating bath, the resulting ferric ions are reduced to ferrous ions by causing stannous ions to be oxidized to stannic ions, which results in the formation of sludge. In order to prevent oxidation of stannous ions, sodium ferrocyanide ($Na_4Fe(CN)_6$) is added. Sodium ferrocyanide reacts with ferric ions to form ferric ferrocyanide ($Fe_4[Fe(CN)_6]_3$) which precipitates in the sludge.

Accordingly, the sludge in the plating bath contains cyanides and fluorides after halogen-type electrolytic tinplating of the steel sheet. Sludge primarily containing $Na_3FeF_6$ and $Fe_4[Fe(CN)_6]_3$ is called "blue sludge", whereas sludge primarily containing $Na_2SnF_6$ is called "white sludge", based on their respective colors. For the purpose of a clearer explanation of the present invention, the blue sludge and its reaction product may be referred to as "iron-containing sludge", and the white sludge and its reaction product may be referred to as "tin-containing sludge". Increasing amounts of the blue and white sludges retard the electroplating operation, hence the operation must be suspended to remove the sludge.

Since the sludge contains useful tin, the tin is recovered as a metal by a conventional recovery process as shown in FIG. 5. Such a recovery process, however, consists of many preliminary steps before electrolysis, and thus is economically disadvantageous.

Japanese Kokai No. 57-70242 discloses a method for recovering metallic tin from sludge generated by a halogen-type electrolytic tinplating process, as shown in FIG. 4. In this method, the sludge is converted to a slurry, hot alkali (i.e. NaOH) is added to the slurry, and blue sludge containing large amounts of iron is separated by filtration. On the other hand, acid is added to the filtrate containing white sludge components to adjust the pH to 7 to 13, and the filtrate is subjected to electrolysis in order to recover metallic tin by electrodeposition.

That method, however, has the following disadvantages. When the hot alkali is added to the slurry, some of the tin sludge is deposited together with the iron sludge. Thus, the tin content in the filtrate is decreased, resulting in a reduced tin yield recovered from the filtrate in the subsequent steps. The recovered metallic tin has a relatively low purity of approximately 99.5%. Such low-purity tin does not satisfy the quality requirements for an anode for tin plating of steel sheets for cans. Moreover, since the method aims only at recovery of metallic tin, the solution containing large amounts of nonrecoverable fluorine components is wasted.

Japanese Kokai No. 9-103790 discloses another method for recovering tin. Sludge is subjected to leaching with acidic water (pH 5.5 to 6) containing an oxidizing agent to remove blue sludge. The pH of the filtrate is adjusted to 7.5 to 9.0 to precipitate tin hydroxide or tin oxide hydrate. The precipitate is then reduced to metallic tin.

The reduction processes proposed in this method include a molten-salt reduction process and a smelting reduction melting process in which the precipitate is melted with graphite and the resulting iron is separated based on the difference in the melting point. These reduction processes are dry processes and involve formation of fine particles, resulting in environmental hazards during the operation. Furthermore, the melting point of the precipitate changes depending on the iron content in the precipitate; therefore the temperature and the reduction are controlled only with great difficulty. As a result, the purity and yield of tin decrease.

Japanese Kokai No. 9-67699 discloses a sludge processing apparatus for performing a process as shown in the flow chart of FIG. 3. The apparatus includes a sludge-separating unit, a white-sludge processing unit, and a blue-sludge processing unit. The sludge-separating unit separates the initial sludge into an aqueous white-sludge solution containing stannous ions and a blue-sludge solid content. The white-sludge processing unit recovers metallic tin from the aqueous solution, whereas the blue-sludge processing unit decomposes the solid content into harmless compounds which can be safely disposed of. In this method, NaOH is added to the aqueous solution containing stannous ions to form white sludge primarily containing $SnO_2.nH_2O$. The white sludge is heated with a carbon reducing agent to form a metallic tin melt, while iron is removed based on the difference in its melting point. The remaining tin is cast as an ingot.

This method therefore also uses a difference in the melting point for separating tin from iron, as in Japanese Kokai No. 9-103790. Thus, this method has disadvantages of unsatisfactory separation and environmental pollution due to the formation of fine particles. Furthermore, incorporation of the fine particles into the recovered tin results in a low purity and a low yield of tin. Both the molten-salt reduction process and the smelting reduction melting process require expensive facilities, and thus have economic disadvantages. In Japanese Kokais Nos. 9-103790 and 9-67699, the major part of the filtrate formed by sludge processing is disposed of without recovery of useful components.

The present inventors disclose a method for separating the initially-formed sludge into blue sludge and white sludge and recovering useful components from the waste solution, in Japanese Kokai No. 10-72629. Tin obtained by this method, however, is still insufficiently pure for use an anode for tin plating. This method would also benefit from improvement in the yield of the recovered tin and workability, and simplification of the process in view of process cost reduction.

SUMMARY OF THE INVENTION

The present inventors have been intensively researching a method capable of effectively recovering useful materials contained in the sludge. As a result, the present inventors have discovered a method for separating tin-containing sludge and byproducts formed during the process with significantly higher efficiency, and have completed a method for processing sludge capable of recovering metallic tin at a high purity and a high yield. The filtrates and precipitates formed during the processing method in accordance with the present invention are also effectively recovered for reuse.

For example, the present inventors have examined leaching conditions with water and reduction conditions for the tin-containing solid content. As a result, it was discovered that the electrolytic reduction of an aqueous alkaline solution produced from the tin-containing solid content is not affected by iron components contained in the tin-containing solid content and that metallic tin can be thereby recovered at a high purity and a high yield. The recovered metallic tin can be reused as an anode for tin plating.

Accordingly, a method for processing sludge from a halogen-type electrolytic tinplating process in accordance with the present invention includes a leaching step for leaching the sludge with water at a pH of not more than about 7, a first separation step for separating an iron-containing sludge remaining after the leaching step, a first alkalifying step for alkalifying a filtrate obtained in the first separation step to precipitate tin-containing sludge, a second separation step for separating and recovering the tin-containing sludge precipitated in the first alkalifying step, a second alkalifying step for redissolving the tin-containing sludge in an alkaline solution, and an electrolytic reduction step for electrolytically reducing the alkaline solution.

Preferably, the leaching step is performed under acidic conditions.

More preferably, the leaching step is performed at a pH of 4 or less.

In the first alkaline step, an alkali is preferably added in an amount of 3.5 to 4.5 molar equivalents of the tin in the sludge, and/or the pH of the filtrate is preferably adjusted to 7.5 to 10.

In the second alkaline step, an alkali is preferably added in an amount of at least about 2 molar equivalents of the tin in the sludge, and/or the pH of the filtrate is preferably adjusted to 9 or higher.

Preferably, the electrolytic reduction step is performed in an electrolyte having a tin concentration of about 20 g/l or more.

Preferably, the filtrate obtained in the second separation step is recovered and reused as a component in the plating solution.

In at least one of the first alkalifying step and the second alkalifying step, preferably sodium hydroxide is used for alkalifying.

Preferably, in the first alkalifying step, sodium hydroxide is used for alkalifying, and the filtrate obtained in the second separation step is recovered and reused as a component in the plating solution.

Preferably, at least one of the first separation step and the second separation step is performed by filtration using a filter press.

Preferably the method further includes a third separation step of removing the insoluble substance in the solution after the second alkalifying step.

Preferably, the iron-containing sludge obtained in the first separation step is mixed with calcium oxide to be reused as a raw material for steel manufacturing.

Preferably, the filtrate obtained in the second separation step is treated with at least one material selected from the group consisting of hydrochloric acid, hydrofluoric acid, and a cation exchange resin, to be reused as a component in the plating solution.

In accordance with the present invention, tin can be recovered with a high yield from sludge, and it can be reused. The filtrate formed during the recovery steps and containing large amounts of useful compounds can also be recovered as a plating solution and as an iron source. The sludge can be easily processed by a facility provided for a tin electroplating line. Thus, useful components can be effectively recovered without environmental contamination.

DESCRIPTION OF THE PREFERRED EMBODIMENTS

Figure 1:
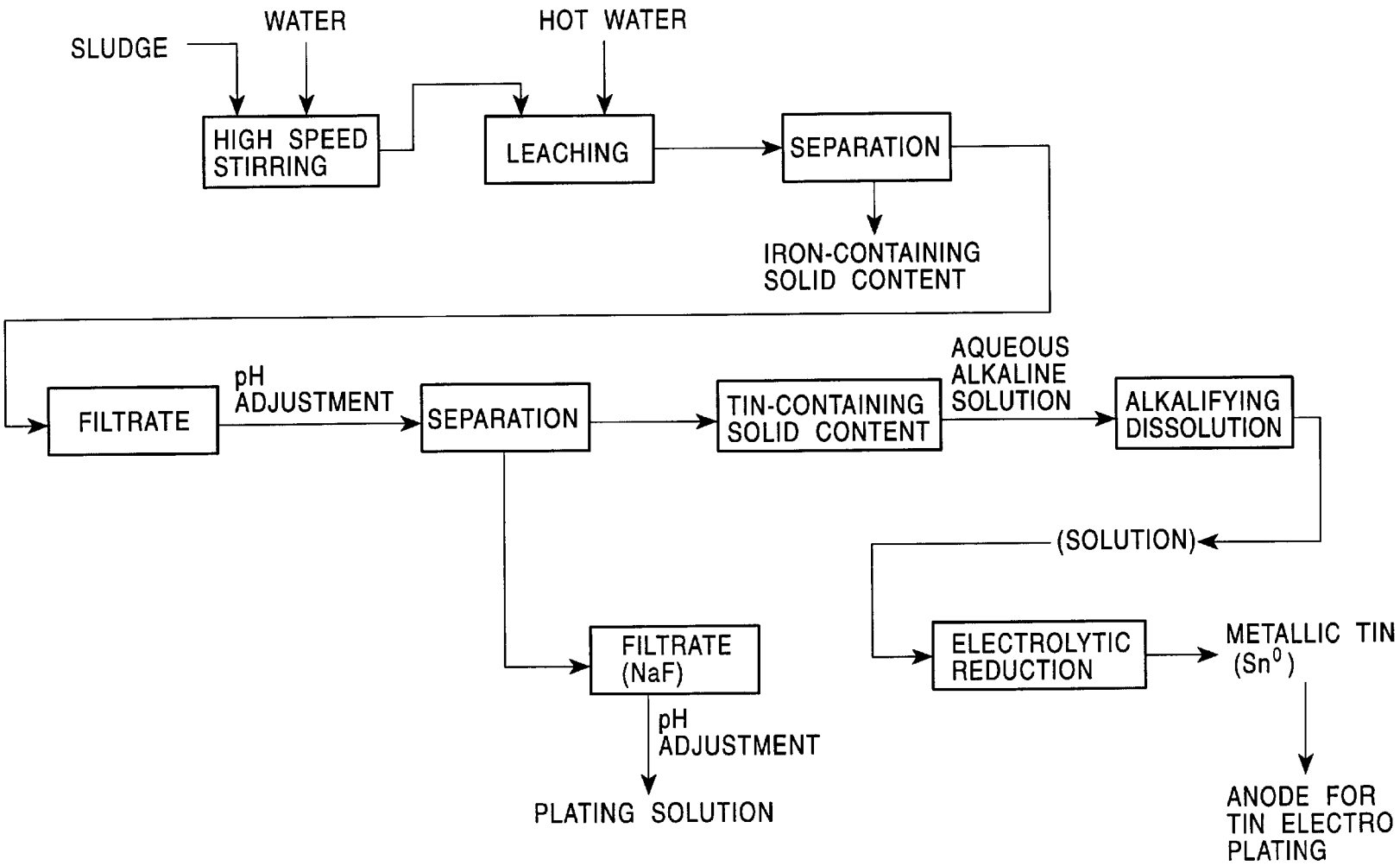
FIG. 1 is a flow chart of a method for processing sludge in accordance with the present invention.

As shown in FIG. 1, sludge, which is formed during halogen-type electrolytic tinplating on a steel sheet, is subjected to leaching with water at a pH of 7 or less. During the leaching, sodium hexafluorostannate ($Na_2SnF_6$) in the sludge migrates into the aqueous phase, whereas sodium hexafluoroferrate ($Na_3FeF_6$) and ferric ferrocyanide ($Fe_4[Fe(CN)_6]_3$) remain as the precipitate. The filtrate containing sodium hexafluorostannate ($Na_2SnF_6$) and sodium fluoride (NaF) is then separated from the solid content containing sodium hexafluoroferrate ($Na_3FeF_6$) and ferric ferrocyanide ($Fe_4[Fe(CN)_6]_3$). The leaching is preferably performed under acidic conditions, and particularly at a pH of 4 or less and more preferably a pH of 1.0 to less than 4. Leaching at a pH of 4 or less prompts migration of tin into the aqueous phase, resulting in an improved yield of tin. A pH higher than 4 causes reduced migration of tin, although undesired inclusion of ferric ions in the aqueous phase is suppressed. An oxidizing agent is preferably added to the leaching solution. The oxidizing agent prompts oxidation of ferrous ions to form ferric compounds having significantly lower solubility in the solution. Examples of the oxidizing agents include hydrogen peroxide $H_2O_2$, oxygen $O_2$, and sodium hypochlorite NaClO. During the leaching with water, it is preferable that hot water be added to the sludge in a volume of 5 to 15 times the volume of the sludge and stirred to convert the sludge into a slurry. The temperature of the hot water is preferably in the range of 50° C. to 70° C. Prior to the leaching, the sludge is preferably subjected to high speed stirring.

The aqueous solution containing the sludge is separated into a solid content and a filtrate. The technique for separation is not particularly limited. Examples of such techniques include filtration, centrifugal separation, and gravitational separation. Among them, filtration with a filter is preferred. In particular, filtration using a filter press enables ready separation of the filtrate from the solid content.

The filtrate contains sodium hexafluorostannate ($Na_2SnF_6$) and sodium fluoride (NaF) as primary components. In the present invention, the pH of the filtrate is adjusted to precipitate tin in the filtrate as tin hydroxide or tin oxide hydrate in a first alkalifying step. Examples of alkali used in the first alkalifying step include aqueous solutions of alkaline hydroxides, such as NaOH, KOH, and LiOH, and ammonium hydroxide $NH_4OH$. For example, when an aqueous NaOH solution is used as an alkali, the following reaction (1) proceeds to precipitate stannic hydroxide $Sn(OH)_4$ or stannic oxide hydrate $SnO_2.nH_2O$:

$$Na_2SnF_6+4NaOH \rightarrow 6NaF+Sn(OH)_4\downarrow \quad (1)$$

According to the formula (1), the stoichiometry of the alkali is four times that of the tin in the sludge, for complete precipitation of stannic hydroxide. In the present invention, the alkali is preferably added in an amount of 3.5 to 4.5 equivalents of tin in the sludge. Since the solubility of stannic hydroxide in the solution depends on the volume of water, the temperature, and the concentration of other ions present in the solution, the pH of the solution is adjusted for promoting the precipitation of stannic hydroxide. In the first alkalifying step, the pH is preferably adjusted to 7.5 to 10, and more preferably to 8 to 9. At a pH lower than about 7.5 or higher than about 10, tin does not precipitate as $Sn(OH)_4$ or remains as $SnO_3^{2-}$ ions in the solution. Thus, the recovery of tin will decrease at a pH substantially outside the above range of 7.5 to 10.

The adjustment of the pH of the filtrate is preferably performed by pouring the filtrate into a reaction vessel and then adding an aqueous alkaline solution such as an aqueous sodium hydroxide solution. Stirring of the solution in the reaction vessel will accelerate the reaction.

In the second separation step, the filtrate and the precipitate are separated into tin-containing sludge $Sn(OH)_4$ and a NaF-containing solution. The NaF-containing solution is recovered and reused as a plating ingredient in the plating solution. Thus, it is preferred that the alkali used in the first alkalifying step be sodium hydroxide. Although the technique for separation is not limited in the second separation step, it is preferably performed by filtration using a filter press, as in the first separation step.

The tin-containing sludge separated in the second separation step is subjected to redissolution with an alkaline solution in a second alkalifying step. Examples of preferred alkaline solutions include aqueous solutions of NaOH, KOH, LiOH and $NH_40H$, although other alkaline solutions containing $[OH]^-$ ions can also be used.

In the second alkalifying step, stannic hydroxide $Sn(OH)_4$ reacts with the alkaline component and is dissolved as $SnO_3^{2-}$ into the solution. When an aqueous NaOH solution is used as the alkaline solution, the reaction represented by the following formula (2) occurs:

$$Sn(OH)_4+2NaOH \rightarrow Na_2SnO_3+3H_2O \quad (2)$$

Stannic hydroxide $Sn(OH)_4$ is converted into $Na_2SnO_3$ which is dissolved in the solution. According to the formula (2), the stoichiometry of the alkali required for redissolution of tin is two times that of tin in the tin-containing sludge. In the present invention, the alkali is preferably added in an amount of 2 equivalents or more of tin in the sludge. Thus, the total amount of the alkaline component used in both the first alkalifying step and the second alkalifying step corresponds to preferably 6 or more equivalents of tin in the formed sludge.

The pH of the solution is preferably also adjusted in the second alkalifying step. The pH is preferably 9 or more, more preferably 10 or more, and most preferably 11 to 13 in the second alkalifying step.

Preferably, the tin-containing solid content is placed into a dissolution vessel and then an aqueous alkaline solution is added to dissolve tin in the solid content. In the dissolution vessel, preferably stirring and heating are performed for prompting the reaction.

In the second alkalifying step, stannic hydroxide $Sn(OH)_4$ is dissolved as described, whereas iron is precipitated as ferrous hydroxide $Fe(OH)_2$ or ferric hydroxide $Fe(OH)_3$. If a trace amount of iron remains in the tin-containing solid content, it can thereby be removed as a precipitate.

A supplemental third separation step will preferably decrease the iron content in the alkaline solution. As a result, metallic tin will be recovered with a higher purity and a higher yield in the subsequent electrolytic reduction step. By employing the alkaline dissolution, it is not necessary to decrease the iron content in the filtrate in the leaching step, and tin effectively migrates from the sludge to the filtrate. As a result, tin can be recovered at a higher purity and a higher yield than in conventional processes.

The solution used for redissolving the tin sludge in the second alkalifying step is used as an electrolyte in the electrolytic reduction step. In this step, metallic tin is electrodeposited on the cathode.

The reaction proceeds in the electrolytic reduction step as represented by the formulas (3a) and (3b):

At the cathode, $$SnO_3^{2-}+4e^-+3H_2O \rightarrow Sn^0+6OH^- \quad (3a)$$

At the anode, $$4OH^- \rightarrow 2H_2O+O_2\uparrow+4e^- \quad (3b)$$

The reduction rate in the electrolytic reduction is represented by the cathode efficiency as follows:

Cathode efficiency (%)=[(amount of tin actually reduced)/(theoretical amount of tin to be reduced based on the Faraday constant)]×100

Figure 2:
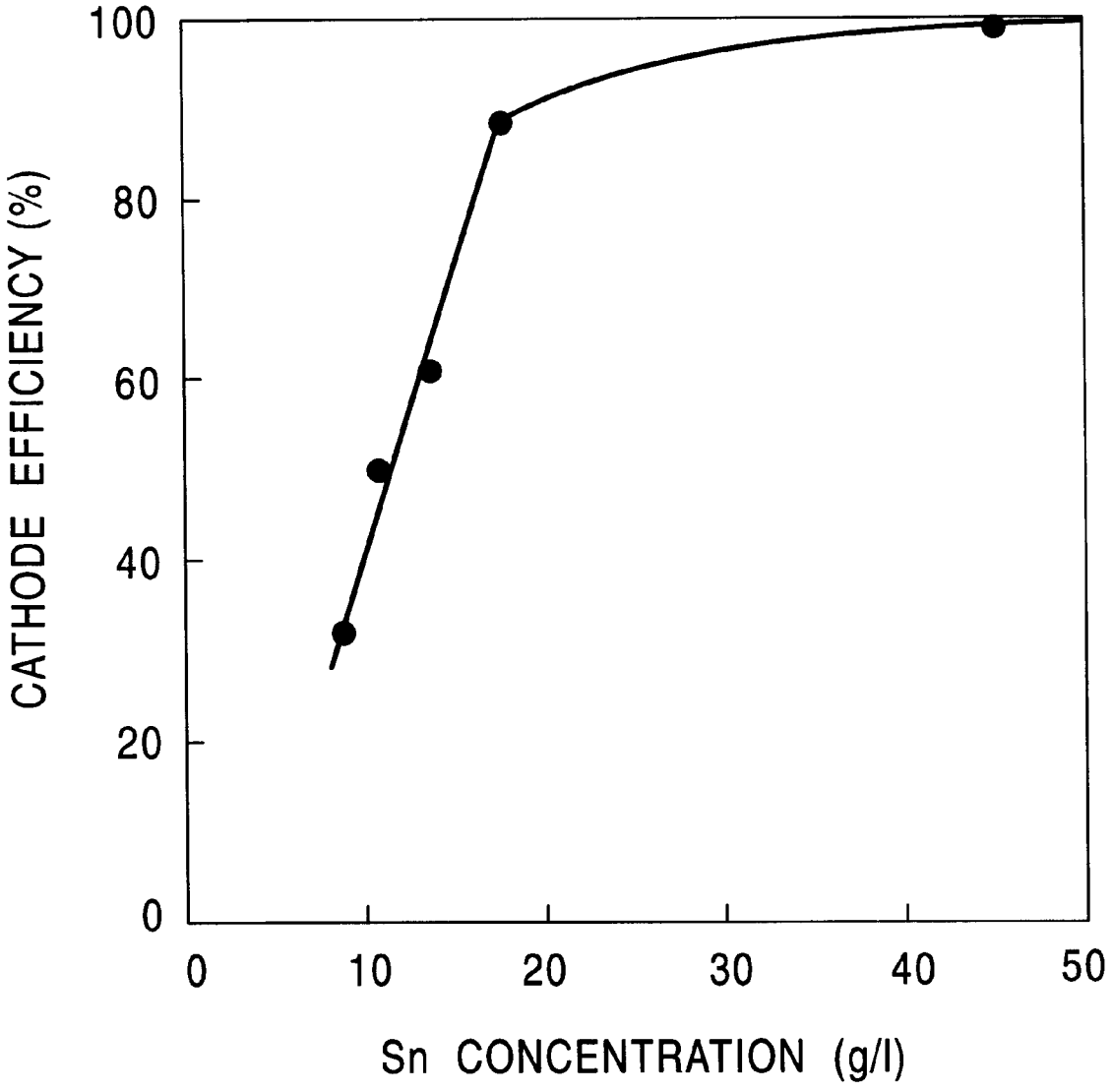
FIG. 2 is a graph of the relationship between the tin concentration and the cathode efficiency in an electrolyte during electrolytic reduction.
Figure 3:
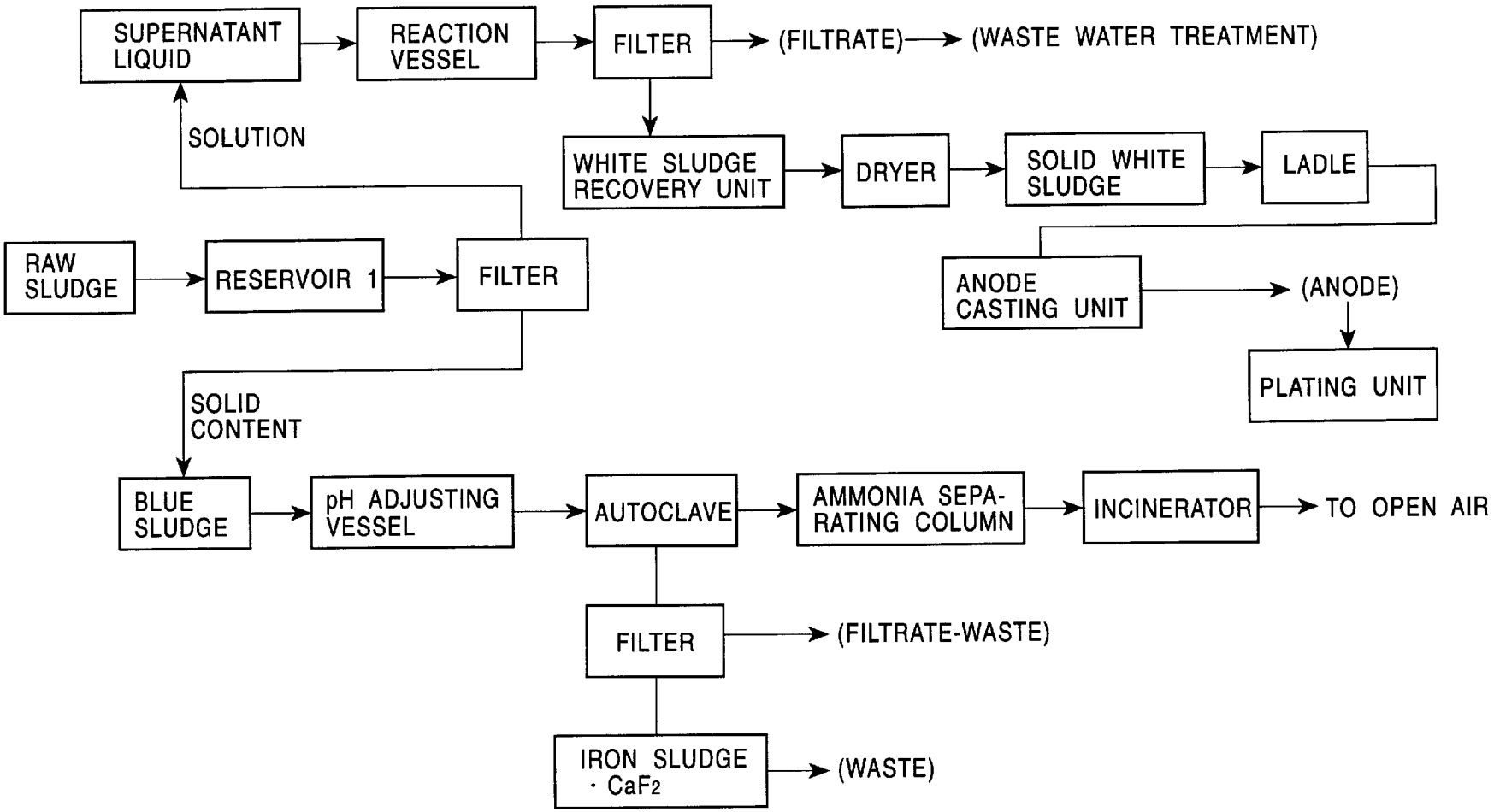
FIG. 3 PRIOR ART
FIG. 3 is a flow chart of a conventional method for processing sludge.
Figure 4:
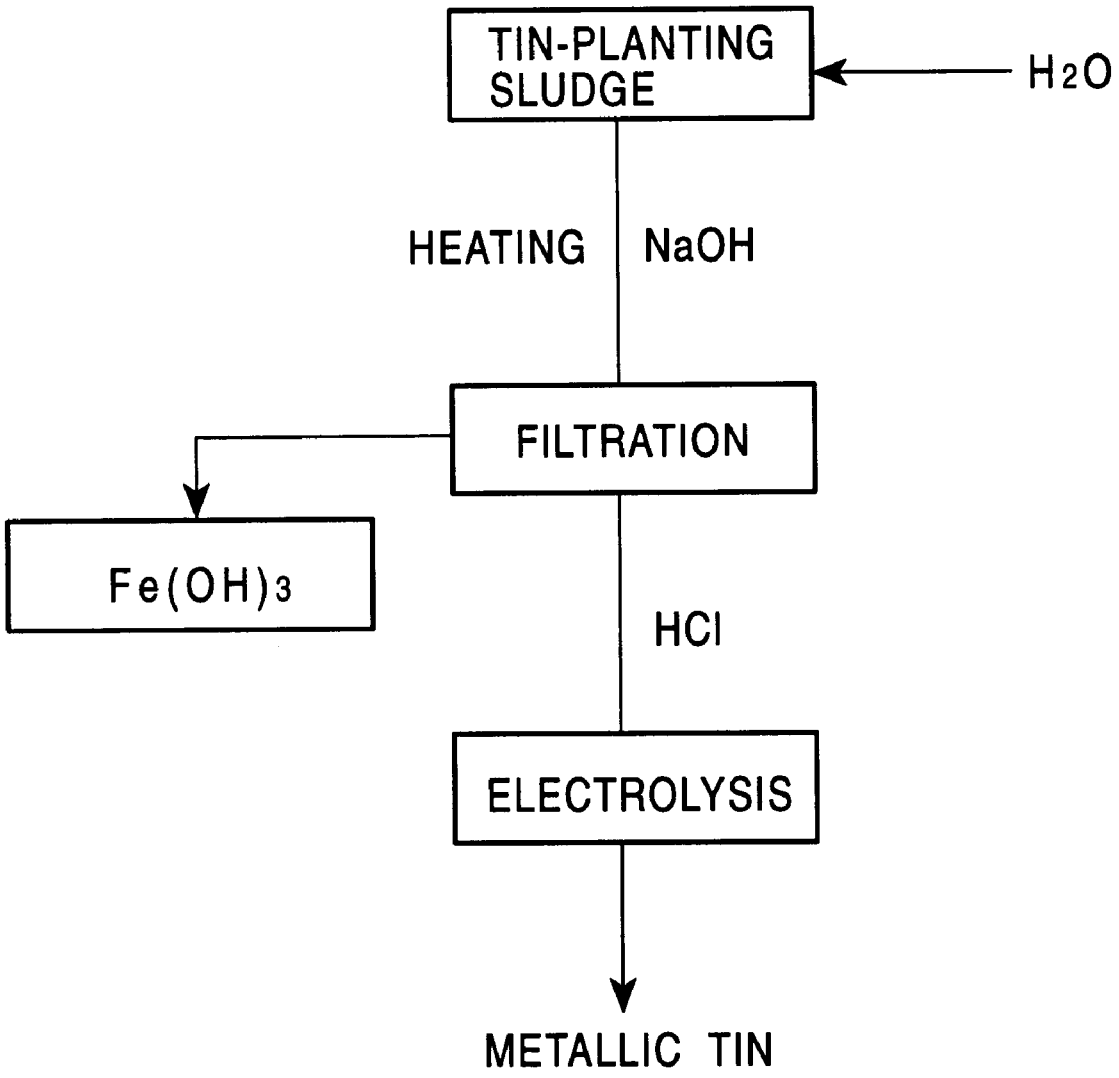
FIG. 4 PRIOR ART
FIG. 4 is a flow chart of a conventional method for processing tin-plating sludge.
Figure 5:
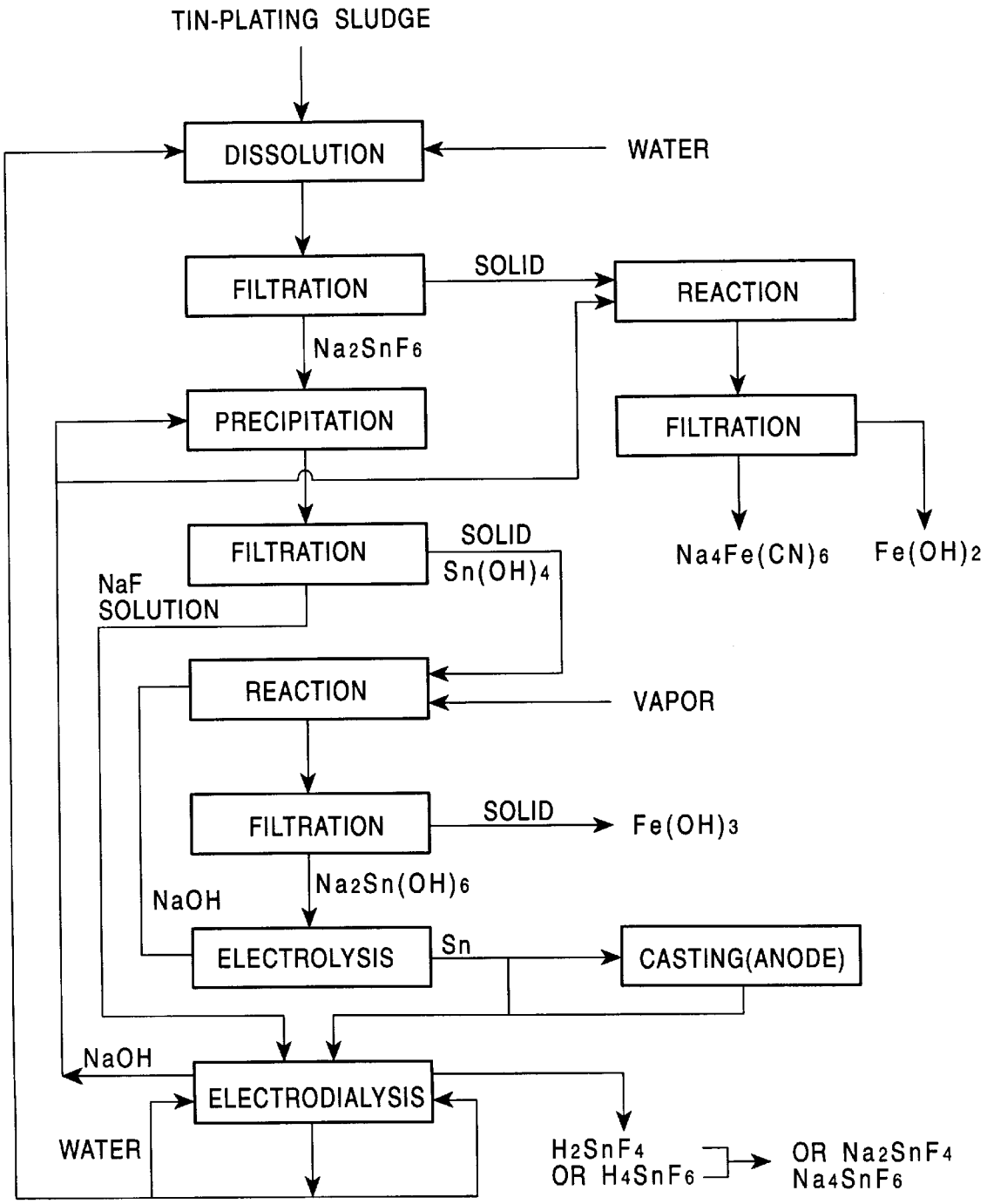
FIG. 5 PRIOR ART
FIG. 5 is a flow chart of a conventional method for processing tin-plating sludge.

The cathode efficiency greatly depends on the Sn content in the electrolyte. As shown in FIG. 2, the cathode efficiency exceeds 90% for a tin concentration of 20 g/l or more and reaches substantially 100% for a tin concentration of 45 g/l or more. Thus, in the present invention the tin concentration in the electrolyte is preferably 20 g/l or more and more preferably 45 g/l or more in view of the improved reduction yield of tin. The tin concentration in the electrolyte is adjusted by the quantity of the tin-containing solid content used.

In the electrolytic reduction step, electrolysis is preferably performed using a metallic tin cathode and a steel sheet anode in the above-mentioned alkaline solution as the electrolyte. In a preferred embodiment, the electrolysis vessel and the alkaline dissolution vessel are connected by a pipe so that the electrolyte is circulated between these vessels by a pump. Preferably, the electrolyte is circulated while monitoring the $SnO_3^{2-}$ concentration in the electrolyte so as to adjust the volume of the additional electrolyte. The electrolysis vessel is preferably provided with a heater for controlling the temperature of the electrolysis vessel. The temperature during electrolysis is controlled in a range of preferably 75° C. to 85° C.

Since the electrolytic reduction step is a wet process using the alkaline solution, the method in accordance with the present invention does not pollute the operational environment, that is, there is no scattering of particles.

The purity of tin recovered in the electrolytic reduction step is 99.9% or more, and it can thus be reused as an anode in tin electroplating.

The conditions for reusing the filtrate formed in the second separation step will now be described. The filtrate contains a large amount of fluorine component which is useful in the plating solution. Since the pH of the filtrate is adjusted to 7.5 to 10 in the first alkalifying step, the filtrate requires pretreatment before reuse as a component of the plating solution. Thus, the pH of the filtrate is adjusted to preferably 3 to 4 before reuse in the plating solution. The adjustment of the pH is preferably performed with hydrochloric acid, hydrofluoric acid or a cation exchange resin. When an increase in the concentration of chloride ions causes problems, sodium cations in the filtrate may be exchanged with hydrogen cations using a cation exchange resin in order to reduce the pH of the filtrate. The filtrate after the pH adjustment can be reused as a component in the plating solution.

The iron-containing sludge separated in the first separation step primarily contains sodium hexafluoroferrate ($Na_3FeF_6$) and ferric ferrocyanide ($Fe_4[Fe(CN)_6]_3$). The sludge is mixed with calcium oxide to fix fluorine as calcium fluoride. The resulting substance can be reused as a raw material for making a steel sheet in a blast furnace. Alternatively, the sludge is mixed with ferrous sulfate so that soluble ferrocyanide ions ($[Fe(CN)_6]^{4-}$) are converted to insoluble ferric ferrocyanide ($Fe_4[Fe(CN)_6]_3$) which latter is disposable.

Examples 1 to 3

Sludge, formed in a plating bath during a halogen-type electrolytic tinplating process, was subjected to leaching with hot water at 60° C. The pH of the hot water was first adjusted to 3.4 or 4.6 with NaOH. In the leaching step, $H_2O_2$ was added as an oxidizing agent for ferrous ions.

After the leaching, the first separation step was performed with a filter press to separate the solution containing sludge into a solid content mainly composed of iron components and a filtrate containing a large amount of dissolved tin. An aqueous NaOH solution was added to the filtrate to adjust the pH of the filtrate as shown in Table 1, and then the resulting suspension which includes tin-containing sludge was subjected to solid/liquid separation using a filter press.

In the second alkalifying step, an aqueous sodium hydroxide solution was added to 930 kg of the tin-containing sludge for redissolving the sludge. The concentration of tin was set to 30 g/l. The alkaline solution was transferred into an electrolyte vessel and subjected to electrolytic reduction at 80° C. using a metallic tin cathode and a steel sheet anode.

The tin and iron concentrations in the filtrate and solid content after each step and the purity and yield of tin were determined. The results are shown in Table 1. The yield of tin was 74 to 83% and was satisfactorily high. The purity of metallic tin was 99.9% and iron was not detected in the tin. This purity is satisfactorily high and it can be used for tin plating of a steel sheet for cans.

Comparative Example 1

From sludge of the same amount as in Example 1, a slurry was prepared based on the method disclosed in Japanese Patent Laid-Open No. 57-70242, and directly combined with a hot alkaline solution, without the leaching and first separation steps of the present invention. The resulting precipitate was removed by filtration. The pH of the filtrate was adjusted with an acid for electrolytic reduction. The yield of the recovered metallic tin was 50% of the total tin content (290 kg) in the sludge and the purity was 99.5%.

Comparative Example 2

The same amount of sludge was subjected to leaching using hot water at 60° C. based on the method disclosed in Japanese Kokai No. 9-103790. The pH of the hot water was adjusted to 5.8 using NaOH. In the leaching, $H_2O_2$ was added as an oxidizing agent for ferrous ions. The resulting tin-containing sludge (tin hydroxide) was dried to form tin oxide, and then melted with graphite in a reducing furnace, without the redissolving step by means of second alkalifying of the present invention. The temperature of the melt was controlled for separating iron, and the melted tin was removed. The melted tin was cast into an ingot. The yield of the recovered metallic tin was 64% of the total tin content (290 kg) in the sludge and the purity was 99.7%.

TABLE 1

| | pH of Leaching solution | Concentration (g/l) in filtrate after leaching | | pH adjusted after first alkalifying step | Composition of tin-containing solid content (wt %) | | | Electrolytic Reduction | | | | |
|---|---|---|---|---|---|---|---|---|---|---|---|---|
| | | | | | | | | Electrolyte | | Recovered metallic tin | | |
| | | Total tin | Total iron | | Total iron | Total tin | $Sn(OH)_4$ | Tin conc. (g/l) | Temp. (°C.) | Weight (kg) | Purity (%) | Yield (%) |
| EX. 1 | 3.4 | 22.3 | 0.05 | 8.5 | 0.24 | 27.0 | 42.5 | 30 | 80 | 241 | 99.9 | 83 |
| EX. 2 | 5.6 | 20.0 | 0.01 | 8.5 | 0.26 | 25.4 | 39.9 | 30 | 80 | 216 | 99.9 | 74 |
| EX. 3 | 4.6 | 21.0 | 0.03 | 8.5 | 0.25 | 26.1 | 40.5 | 40 | 80 | 230 | 99.9 | 79 |
| COMP. EX. 1 | 12.5*1 | — | — | 10.0 | Not separated as solid content | | | 15 | 80 | 145 | 99.5 | 50 |
| COMP. EX. 2 | 5.8 | 19.8 | 0.01 | 8.5 | 0.23 | 22.0 | 34.6*2 | Heat-melting reduction | | 186 | 99.7 | 64 |

EX.: EXAMPLE, COMP. EX: COMPARATIVE EXAMPLE
*1Treated with a hot alkaline solution but without leaching.
*2Not subjected to the second alkalifying step.

In Examples 1–3 in accordance with the present invention, the recovered tin has a high purity and a high yield of 74% or more regardless of a high iron content in the filtrate after the leaching step. The yield is improved by 10% or more compared with Comparative Examples 1 and 2. The yield increases as the pH of the leaching solution decreases.

In Comparative Example 2, the recovery of metallic tin is performed by a dry process at a high temperature of approximately 1,000° C., whereas the method in accordance with the present invention is based on the wet process at a temperature of less than 100° C. Thus, the operation of the method in accordance with the present invention is simplified.

The metallic tin recovered in Examples 1 to 3 was reused as an anode in tin plating. The pH of the filtrate from the first separation step having a pH of 8.5 was adjusted to 3.5 with hydrochloric acid to be reused as a plating solution.

The solid content, which was separated from the leaching solution, is substantially composed of sodium hexafluoroferrate ($Na_3FeF_6$) and ferric ferrocyanide ($Fe_4[Fe(CN)_6]_3$). The solid content was mixed with calcium oxide which fixes fluorine as calcium fluoride so as to prevent generation of free fluorine, and was reused as a raw material for steel sheet production. Calcium oxide was added in an amount of two times the stoichiometry required for completely converting fluorine into calcium fluoride.

Modifications of the invention herein disclosed will occur to a person skilled in the art and all such modifications are deemed to be within the scope of this invention as defined by the appended claims.

What is claimed is:

1. A method for processing sludge generated by a halogen electrolytic tinplating process, said method comprising:

a) leaching the sludge with water at a Ph of 7 or less;

b) separating an iron-containing sludge remaining after said leaching step a) to obtain a resulting solution;

c) alkalifying the resulting solution obtained in said separating step b) to precipitate tin-containing sludge;

d) separating and recovering said tin-containing sludge precipitated in said alkalifying step c);

e) redissolving said tin-containing sludge in an alkaline solution;

f) electrolytically reducing said alkaline solution obtained in said redissolving step e); and g) reusing metallic tin recovered in said electrolytically reducing step f) as an anode for said halogen electrolytic tinplating process.

2. The method according to claim 1, wherein step a) is performed under acidic conditions.

3. The method according to claim 1, wherein step a) is performed at a pH of 4 or less.

4. The method according to claim 1, wherein step c) comprises adding an alkali in an amount of 3.5 to 4.5 molar equivalents of tin in the sludge.

5. The method according to claim 1, wherein step c) comprises adjusting the pH of the resulting solution to 7.5 to 10.

6. The method according to claim 1, wherein step e) comprises adding an alkali in an amount of 2 or more molar equivalents of tin in the sludge.

7. The method according to claim 1, wherein step e) comprises adjusting the pH of the alkaline solution to 9 or higher.

8. The method according to claim 1, wherein step f) is performed in an electrolyte having a tin concentration of at least about 20 g/l.

9. The method according to claim 1, wherein a separated solution obtained by the separation in step d) is recovered and reused as a component in a plating solution.

10. The method according to claim 1, wherein at least one of steps c) and e) comprises using sodium hydroxide for alkalifying.

11. The method according to claim 1, wherein sodium hydroxide is used for alkalifying in step c), and a separated solution obtained by the separation in step d) is recovered and reused as a component in a plating solution.

12. The method according to claim 1, wherein at least one of steps b) and d) is performed by filtration using a filter press.

13. The method according to claim 1, further comprising:

h) removing insoluble substances from said solution after step e) to obtain a clarified solution, and i) providing the clarified solution to step f) as said alkaline solution.

14. The method according to claim 1, wherein said iron-containing sludge obtained in step b) is mixed with calcium oxide to be reused as a raw material for steel manufacturing.

15. The method according to claim 1, wherein a separated solution obtained by the separation in step d) is treated with at least one material selected from the group consisting of hydrochloric acid, hydrofluoric acid, and a cation exchange resin, to be reused as a component in a plating solution.

16. The method according to claim 1, wherein the pH is raised higher in step e) than in step c).

* * * * *